US005217548A

United States Patent [19]

Kuboki et al.

[11] Patent Number: 5,217,548

[45] Date of Patent: Jun. 8, 1993

[54] PROCESS FOR WORKING β TYPE TITANIUM ALLOY

[75] Inventors: Isao Kuboki; Kenzo Kato; Yutaka Wakabayashi, all of Tokyo, Japan

[73] Assignee: Seiko Instruments Inc., Japan

[21] Appl. No.: 755,288

[22] Filed: Sep. 5, 1991

[30] Foreign Application Priority Data

Sep. 14, 1990 [JP] Japan ..... 2-245205
Feb. 18, 1991 [JP] Japan ..... 3-45780
Jun. 13, 1991 [JP] Japan ..... 3-142111

[51] Int. Cl.[5] ..... C22C 14/00

[52] U.S. Cl. ..... 148/671; 148/421; 148/669; 148/670; 420/902

[58] Field of Search ..... 148/669, 670, 671, 421; 420/902

[56] References Cited

U.S. PATENT DOCUMENTS 4,799,975 1/1989 Ouchi et al. ..... 148/671
4,842,653 6/1989 Wirth et al. ..... 148/671
4,867,807 9/1989 Torisaka et al. ..... 420/902
4,871,400 10/1989 Shindo et al. ..... 148/12.7 B
5,026,520 6/1991 Bhowal et al. ..... 148/670
5,039,356 8/1991 Weiss et al. ..... 148/670

OTHER PUBLICATIONS

Weiss et al. Met. Trans. 17A (1986) 1935.
Avery et al in Titanium Sci. & Techn. vol. 3, eds Jaffee et al (1973) Plenum, p. 1829.

*Primary Examiner*—Upendra Roy
*Attorney, Agent, or Firm*—Bruce L. Adams; Van C. Wilks

[57] ABSTRACT

A process for working β titanium alloy comprises the steps of first elongating the alloy at a temperature not higher than a β transus temperature and at a working ration of 30% or more. Next, conducting a subsequent aging treatment. Then, elongating the alloy at a temperature not higher than the aging treatment temperature and at a working ratio of 70% or more when combined with that in the first step for elongating. Then a recrystallization treatment is carried out at a treating temperature not higher than the β transus temperature or isothermal working is carried out within a temperature range of the β transus temperature minus 200° C. to the β transus.

15 Claims, 1 Drawing Sheet

PROCESS FOR WORKING β TYPE TITANIUM ALLOY

BACKGROUND OF THE INVENTION

1. Field of the invention

The present invention relates to a process for working a β titanium alloy for improving the isothermal workability of the β titanium alloy by forming fine crystalline grains.

2. Description of the Prior Art

A β titanium alloy called the quasi-stable β titanium alloy, which does not undergo a martensitic transus by chilling and takes a β single phase at room temperature, is generally superior in cold workability, This alloy is cold rolled into thin sheets and then subjected to a solution heat treatment in order to remove a work strain for use in sheet forming.

In general, this alloy has a β transus nearly identical with a recrystallization temperature, and recrystallization and grain growth rapidly occur by heat treatment at the β transus temperature or higher. However, no recrystallization occurs by heat treatment at the β transus temperature or lower while an α phase is precipitated along a deformation zone and the like formed in working. Accordingly, conventional solution heat treatment of the β titanium alloy has been conducted at a temperature slightly higher than the β transus and particle diameters of crystalline grains obtained by the treatment have been at most about 20 μm [reported in, for example, the Bulletin of Investigations in the Faculty of Engineering of Ibaragi University., 37, 155 (1989)].

The sheet formation is generally conducted by forming in a die at room temperature utilizing the superior cold workability of the β titanium alloy. Similarly, thick sheets have been obtained by die-forging at room temperature. The hot die-forging and the hot sheet forming have been partially conducted at a solution heat treatment temperature or higher in addition to the cold forming.

Although large deformation of the β titanium alloy by the prior art cold working process is possible without generating edge cracking and surface cracking because of excellent cold workability of the alloy, work hardening occurs requiring that an intermediate annealing step be added and thus the number of steps has been disadvantageously increased. In order to solve this problem, hot working has been conducted at a temperature higher than the solution heat treatment temperature to reduce the deformation stress. However, in the hot working and the isothermal working according to the prior art, the β titanium alloy is heated to a temperature higher than the solution heat treatment temperature, so that grains are apt to grow and thus the surface of the formed product tends to be rough. In addition, the formation of coarse particles may have an adverse effect on the mechanical properties after the working. Furthermore, in the conventional hot working and the isothermal working, the material was not largely deformed at a reduced stress and near final shaping was extremely difficult.

In order to solve the above-described problems, according to the present invention, a β titanium alloy is subjected to elongating, aging and elongating in the order described to form fine crystalline grains during the time when it is heated to the isothermal working temperature and held at that temperature and thus a super-plasticity capable of undergoing large deformation with a reduced stress can be exhibited. Such a super-plastic phenomenon can be utilized for not only a reduction in the manufacturing costs but also the diversification in design due to superior transferability and diffusion joinability.

SUMMARY OF THE INVENTION

A β titanium alloy is elongated at a working ratio of 70% or more within a temperature range where a relatively easily workable a phase is limitedly precipitated Next, the alloy is subjected to a precipitation treatment within an (α+β) biphase range not lower than 400° C. but not higher than the β transus temperature to uniformly precipitate a fine α phase, followed by isothermal working at a temperature of the precipitation treatment or above within a temperature range not lower than 650 ° C. but not higher than the β transus temperature to impart a superior super-plasticity to the β titanium alloy.

If the β titanium alloy is subjected to a strong working and then heated to a temperature not lower than 400° C. but not higher than the β transus temperature, the fine β phase is uniformly precipitated in a short time. If the β titanium alloy having such a structure is heated to a temperature not lower than the precipitation treatment temperature and now lower than 650° C. but not higher than the β transus temperature, crystalline grain boundaries of the matrix β phase (or subgrain boundaries) are pinned by the precipitated α phase particles and become difficult to move, thereby forming a very fine crystalline particle (or subgrain) structure. Thus, the β titanium alloy exhibits the super-plastic phenomenon in the isothermal working by forming fine crystalline grains in the above described manner.

Further, the β titanium alloy is working at such a temperature and working ratio that deformed bands and slip lines serving as precipitation sites are uniformly dispersed so that the α phase may be uniformly precipitated by the aging treatment to uniformly precipitate the α phase all over the material. The alloy is further worked at temperatures lower than the aging treatment temperature to introduce strains and to make crystalline grains fine by subsequent recrystallization.

Strains are accumulated around the precipitated α phase to a remarkable extent by the working after the aging to increase a strain energy which serves as a driving force in the recrystallization and complete the recrystallization at the β transus temperature or lower. The completion of the recrystallization at the β transus temperature or lower leads to a suppression of the growth of the recrystallized grains in the β phase by the precipitated α phase, thereby giving fine crystalline grains. The working prior to the aging is carried out for uniformly precipitating the α phase so that the strain may be uniformly spread over the surface of the material in order to form uniform fine recrystallized grains all over the surface of the material.

Furthermore, the β titanium alloy is elongated at a working ratio of 30% or more within a temperature range where an α phase is limitedly precipitated and the recrystallization does not occur, that is a temperature of the β transus or lower. The alloy is aged within a temperature range of the β transus to the β transus minus 200° C., worked at a total working ratio of 70% or more and a temperature not higher than the aging treatment temperature, and isothermally worked at a temperature not a higher than the $\beta$ transus to impart a super-plasticity to the $\beta$ titanium alloy.

If the $\beta$ titanium alloy is worked prior to the aging treatment for precipitating the $\alpha$ phase, the $\alpha$ phase is uniformly precipitated. If the $\beta$ titanium alloy consisting of the uniformly precipitated $\alpha$ phase and the matrix $\beta$ phase is worked, a strain energy serving as a driving force in the subsequent recrystallization step is readily accumulated. If the $\beta$ titanium alloy which has been elongated, aged and again elongated is heated to a temperature slightly lower that the $\beta$ transus, the $\alpha$ phase is precipitated. Also within this biphase zone, recrystallization proceeds rapidly to form a uniform fine texture composed of the granular $\alpha$ phase and the matrix $\beta$ phase. The matrix $\beta$ phase has a subgrain texture according to circumstances. The heating to the temperature immediately below the $\beta$ transus in order to form the uniform fine texture can be utilized also for starting isothermal deformation, so that it is not necessary to conduct a preliminary heat treatment prior to the isothermal deformation. When the $\beta$ phase is recrystallized, the $\alpha$ phase is granulated to suppress the growth of grains in the $\beta$ phase, thereby forming fine crystalline grains.

DETAILED DESCRIPTION

Figure 1:
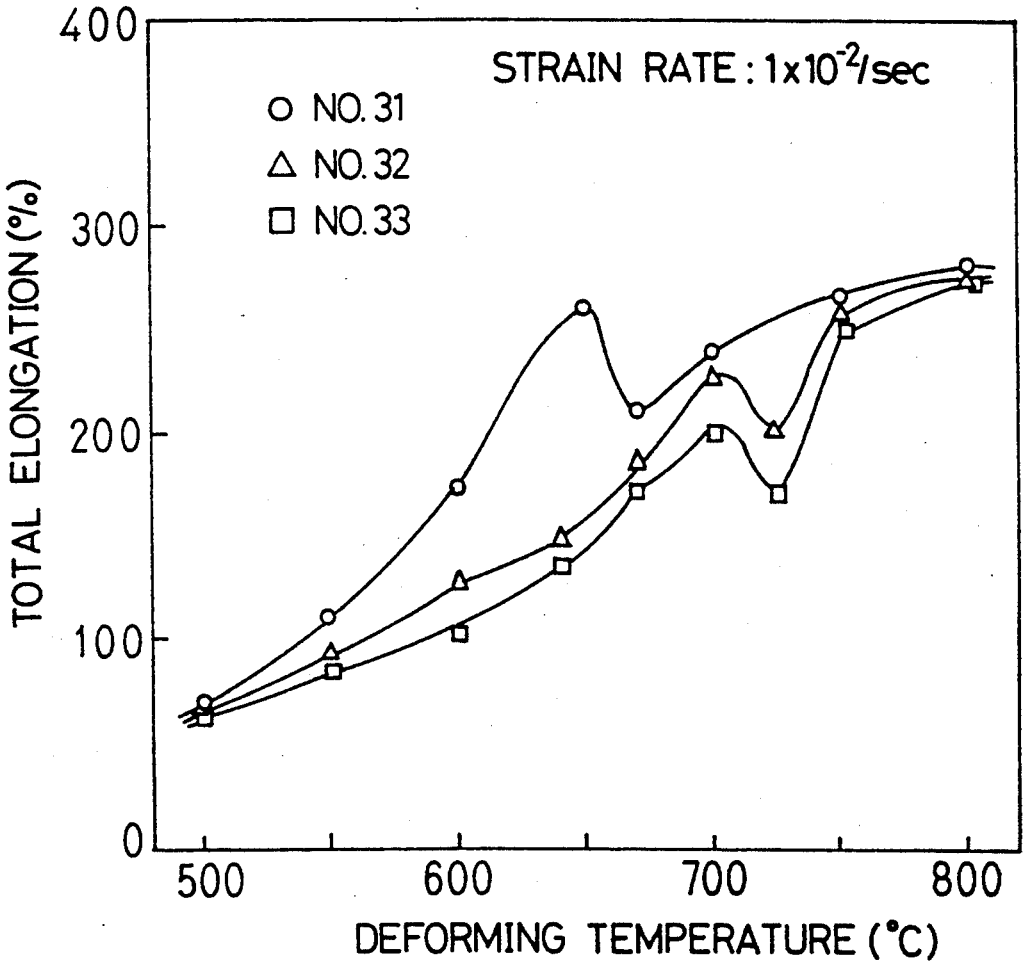
FIG. 1 is a diagram showing a relation between the deforming temperature and the total elongation according to the present invention.

The present invention will now be described in detail with reference to examples.

EXAMPLE 1

The sample material used in example 1 is a sheet having a thickness of 5mm made of a $\beta$ titanium alloy having a chemical composition shown in Table 1 and subjected to solution heat treatment. The following two kinds of samples were prepared from this sample material. One is a 70% cold-rolled material of 1.5 mm thick (No. 11) obtained by subjecting the sample material to cold rolling at a draft of 70%. The other is a solution heat treated material having particle diameters of about 75 μm (No. 12) obtained by subjecting No. 11 to a solution heat treatment. Tensile test pieces were sampled from these sheets of 1.5 mm thick.

TABLE 1

| Chemical composition of the sample material in wt % | | | | |
|---|---|---|---|---|
| V | G | Sn | Al | Ti |
| 15.6 | 3.31 | 3.00 | 3.31 | balance |

Then, these two kinds of test pieces were subjected to a precipitation treatment for 1 hour at 400° C., 500° C., 600° C. and 700° C., respectively. A high-temperature tensile test was conducted for two kinds of test pieces subjected to the precipitation treatment and two kinds of test pieces not subjected to the precipitation treatment in a vacuum under the conditions of a temperature of 600° to 800° C. and a strain rate of $1\times10^{-4}$ to $1\times10^{-1}$/sec. The total elongation of each of No.11 and No.12 was measured in such a manner. The values of the total elongation at the strain rate of $1\times10^{-3}$/sec are shown in Table 2.

TABLE 2

Influences of the tensile test temperature and the precipitation treatment temperature upon the total elongation when Samples No. 11 and No. 12 were deformed at a strain rate of $1\times10^{-3}$/sec

| Test piece | Precipitation treatment temperature | % Test temperature 600° C. | 650° C. | 700° C. | 750° C. | 800° C. |
|---|---|---|---|---|---|---|
| No. 11 (draft 70%) | No treatment | 100 | 150 | 260 | 340 | 220 |
| | 400° C. | 110 | 200 | 350 | 340 | 210 |
| | 500° C. | 100 | 190 | 330 | 350 | 220 |
| | 600° C. | 90 | 170 | 300 | 350 | 220 |
| | 700° C. | — | — | 230 | 360 | 210 |
| No. 12 (draft 0%) | No treatment | 90 | 120 | 170 | 240 | 220 |
| | 400° C. | 90 | 110 | 150 | 240 | 220 |
| | 500° C. | 80 | 120 | 170 | 240 | 220 |
| | 600° C. | 90 | 120 | 160 | 240 | 210 |
| | 700° C. | — | — | 130 | 240 | 220 |

It is apparent from Table 2 that as for the test piece No.11 cold-rolled at a draft of 70%, the total elongation is increased within a temperature range of 650° to 750° C. by conducting the precipitation treatment at the tensile test temperature or lower prior to the tensile test and thus the same value of total elongation can be obtained for No.11 at a temperature lower than that for the No.12. In this case, $\beta$ transus of the sample material was 750° C. This temperature is dependent upon the composition of the alloy and the contents of H, O, N and the like in the gas. If the draft of the test piece is 70% or more, finer crystalline grains can be obtained, so that it is evident that the total elongation can be increased.

In addition, unless the precipitation treatment temperature is 400° C. or higher, the $\alpha$ phase is hardly precipitated in a short time which is practically disadvantageous, so that the precipitation treatment temperature was set at 400° C. or higher.

The above-described increased total elongation by the precipitation treatment results from the pinning effect of the uniformly precipitated fine $\alpha$ phase on the grain boundaries of the matrix $\beta$ phase, so that it can be clearly applicable for every $\beta$ titanium alloy which can be subjected to a strong working, without being limited to the $\beta$ titanium alloy having the above-described chemical composition.

As described above, a super-plasticity of the $\beta$ titanium alloy can be exhibited in the isothermal working thereof and the total elongation can be remarkably increased in comparison with that in the conventional hot working and isothermal working by subjecting the alloy to a remarkably simple preworking and the subsequent precipitation treatment. As a result, not only can the manufacturing cost be reduced, but also the design can be diversified making the most of the superior transferability and diffusion joinability.

In addition, cold rolling at an increased draft is possible, so that a thin band capable of being precisely regulated in thickness can be produced. The joining of metals to metals or metals to ceramics skillfully utilizing the high deformability and diffusion joinability becomes possible by working this thin band by putting it between the same or different kinds of materials.

EXAMPLE 2

The sample material used in example 2 is a sheet having a thickness of 5mm made of a $\beta$ titanium alloy having a chemical composition shown in Table 1 and subjected to the solution heat treatment.

Four kinds of samples No.21, No.22, No.23 and No.24 as shown in Table 3 were prepared from this sample material. No.21 was prepared by cold rolling the sample material at a working ratio 30%, aging it for 1 hour at 650° C., hot rolling it at 650° C. and a working ratio 60%, and recrystallizing for 10 minutes at 680° C. No. 22 was prepared by conducting the cold rolling prior to the aging of No. 21 at a working ratio 10% and conducting the recrystallization at 720° C. No. 23 was prepared by conducting the hot rolling after the aging of No. 21 at a working ratio 30% and 650° C. No. 24 was prepared by conducting the recrystallization treatment of No. 21 at 750° C. These working and heat treating conditions are summarized in Table 3.

TABLE 3

| | Working and heat treating conditions | | | | | | | |
|---|---|---|---|---|---|---|---|---|
| | First step for elongating | | Second step for Aging | | Third step for elongating | | Fourth step for Recrystal | |
| Sample | Temp. | Working ratio | Temp. °C. | Time min. | Temp. °C. | Working ratio | Temp. °C. | Time min. |
| No. 21 | Room temp. | 30% | 650 | 60 | 650 | 60% | 680 | 10 |
| No. 22 | Room temp. | 10% | 650 | 60 | 650 | 60% | 720 | 10 |
| No. 23 | Room temp. | 30% | 650 | 60 | 650 | 30% | 720 | 10 |
| No. 24 | Room temp. | 30% | 650 | 60 | 650 | 60% | 750 | 10 |

Subsequently, the tertures of these samples No. 21, No. 22, No. 23 and No. 24 were observed. The results are shown in Table 4.

TABLE 4

| Uniformity of distribution of the α phase and a mean crystalline particle diameter of the β phase in the samples subjected to various kinds of working and heat treatment | | |
|---|---|---|
| Sample | Uniformity of distribution of α phase | Mean crystalline particle diameter |
| No. 21 | c | 1 μm |
| No. 22 | x | 7 μm |
| No. 23 | Δ | 9 μm |
| No. 24 | no α phase precipitated | 18 μm |

c: good;
Δ: not so good;
x: bad

No. 21 had a texture in which the precipitated α phase was also uniformly distributed and the crystalline grains were remarkably fine. No. 21, No. 22 and No. 23 each had a texture in which the β phase was not uniformly distributed and also the crystalline particle diameters were relatively large.

Since it is apparent that in the elongating before and after the aging, the larger the working ratio, the more uniform the distribution of the α phase and the the crystalline grains in the β phase, the rolling before the aging was conducted at a working ratio 30% and the rolling after the aging was conducted at a working ratio 60% or more. In addition, since and object of the rolling consists in an accumulation of strains, the rolling was conducted at the β transus or lower at which the α phase neither formed solid solution nor recrystallized. Unless the α phase is precipitated, grains are rapidly grown by the recrystallization treatment as in No.24, so that the recrystallization temperature was set at the β transus or lower.

Although a Ti-15V-3Cr-3Sn-3Al alloy is used in the present example, it goes without saying that the working and heat treating according to the present invention can also be applied to other β titanium alloys.

As described above, the crystalline grains of the β titanium alloy can be made fine by subjecting it to the aging treatment for precipitating the α phase, the working conducted before and after the aging treatment, such as elongating, and the recrystallization treatment for forming fine crystalline grains in combination. As a result, an effect is obtained in that the mechanical properties at room temperature and the workability at high temperatures can be improved.

EXAMPLE 3

The sample material used in example 3 is a sheet having a thickness of 5mm made of a β titanium alloy having a chemical composition shown in Table 1 and subjected to the solution heat treatment.

The following three kinds of samples No.31, No.32 and No.33 were prepared. No.31 was prepared by cold rolling the sample material at a working ratio 30%, aging it for 1 hour at 650° C., and hot rolling it at 650° C. and a working ratio of 60%. No.32 was prepared in the same manner as that of No.31 excepting that the cold rolling prior to the aging treatment was carried out at a working ratio 10% and No.33 was prepared in the same manner as that of No.31 excepting that the hot rolling at 650° C. after the aging treatment was carried out at a working ratio 30%. These working and heat treatment methods are summarized in Table 5.

TABLE 5

| | First step for elongating | | Second step for Aging | | Third step for elongating | |
|---|---|---|---|---|---|---|
| Sample | Temp. | Working ratio | Temp. °C. | Time min. | Temp. °C. | Working ratio |
| No. 31 | Room temp. | 30% | 650 | 60 | 650 | 60% |
| No. 32 | Room temp. | 10% | 650 | 60 | 650 | 60% |
| No. 33 | Room temp. | 30% | 650 | 60 | 650 | 30% |

As for No.32, 33, both surfaces to be rolled were cut to a sheet thickness of 1.4 mm by means of a milling machine in order to make them equal to No.31 in sheet thickness. Tensile test pieces were prepared from No.31, No.32 and No.33 having a sheet thickness of 1.4 mm. A high-temperature tensile test (isothermal working) was conducted with these tensile test pieces. The high-temperature tensile test was conducted by means of an Instron-type tensile tester at a strain rate of $1\times10^{-2}$/sec within a temperature range of 500° to 800° C. ($\beta$ transus temperature : 750° C.). A holding time at the test temperature was set at 10 minutes. The values of a total elongation measured in the above described manner are shown in FIG. 1.

It is apparent from FIG. 1 that No.31 exhibits a total elongation larger than that of No.32 and No.33 within a temperature range of 550° to 750° C. Such a tendency is keen in particular within a relatively lower temperature range of 600° to 650° C. Since the fine $\alpha$ phase uniformly precipitated serves to make the matrix $\beta$ phase fine and stabilize the $\alpha$ phase at high temperatures, it goes without saying that if the $\beta$ transus is changed by a change of the alloy in the chemical composition, also the temperature range where the total elongation is improved is changed.

Accordingly, the temperature range where the isothermal working is carried out was set at a range of the $\beta$ transus to the $\beta$ transus minus 200° C. where the $\alpha$ phase and the $\beta$ phase coexist It is evident that if the working ratio of the samples is 70% or more in total, finer crystalline grains can be formed, so that the total elongation can be improved Furthermore, even though the strain rate in the isothermal working is changed, a tendency that No 31 exhibits the largest total elongation is unchanged.

As described above, according to the present invention, a super-plasticity is imparted to the $\beta$ titanium alloy in the isothermal working to remarkably increase the total elongation in comparison with that (about 60%) in the conventional hot working and isothermal working by subjecting the $\beta$ titanium alloy to a remarkably simple working and heat treatment, such as elongating, aging and elongating again, and starting the working at a temperature not higher than the $\beta$ transus. The appearance of the super-plasticity results from the formation of the fine crystalline grains, so that not only the total elongation can be increased but also the deforming stress can be reduced As a result, not only can the manufacturing cost be remarkably reduced but also the design can be diversified utilizing the superior transferability and diffusion joinability.

In addition, the cold rolling at an increased working ratio is possible, so that a thin band capable of being precisely regulated in thickness can be produced. Also, the joining of metals to metals or metals to ceramics skillfully utilizing the high deformability and diffusion joinability becomes possible by working this thin band by putting it between the same or different kinds of material.

What is claimed is:

1. A process for working $\beta$ titanium alloy having superplastic elongation characteristics, comprising the steps of:

(a) elongating the $\beta$ titanium alloy, (b) precipitating an $\alpha$ phase in the $\beta$ titanium alloy within a temperature range of 400° C. to a $\beta$ transus temperature, and (c) working the $\beta$ titanium alloy at an isothermal working temperature.

2. A process for working $\beta$ titanium alloy as claimed in claim 1, wherein the elongating is carried out at a working ratio of at least 70%.

3. A process for working $\beta$ titanium alloy as claimed in claim 1, wherein the isothermal working is carried out within a temperature range of 650° C. to a $\beta$ transus.

4. A process for working $\beta$ titanium alloy having superplastic elongation characteristics, comprising the steps of:

(a) a first step of elongating the $\beta$ titanium alloy, (b) a second step of aging the $\beta$ titanium alloy at a temperature between 500° C. and 800° C. for at least one hour, (c) a third step of elongating the $\beta$ titanium alloy after the second step, and (d) a fourth step of recrystallizing the $\beta$ titanium alloy.

5. A process for working $\beta$ titanium alloy as claimed in claim 4, wherein the first step of elongating has a temperature not higher than a $\beta$ transus when the first step of elongating is completed and a working ratio of at least 30%.

6. A process for working $\beta$ titanium alloy as claimed in claim 4, wherein the third step of elongating has a temperature not higher than the aging treatment temperature when the third step of elongating is completed, and a working ratio of at least 70%.

7. A process for working $\beta$ titanium alloy as claimed in claim 4, wherein the fourth step of recrystallizing has a temperature not higher than a $\beta$ transus.

8. A process for working $\beta$ titanium alloy having superplastic elongation characteristics, comprising the steps of:

(a) a first step of elongating the $\beta$ titanium alloy, (b) a second step of aging the $\beta$ titanium alloy at a temperature between 500° C. and 800° C. for at least one hour, (c) a third step of elongating the $\beta$ titanium alloy after the second step, and (d) a fourth step of working the $\beta$ titanium alloy at an isothermal working temperature.

9. A process for working $\beta$ titanium alloy as claimed in claim 8, wherein the third step of elongating has a temperature not higher than the aging treatment temperature when the third step of elongating is completed, and a total working ratio of at least 70% including the working ratio in the first step of elongating.

10. A process for working $\beta$ titanium alloy as claimed in claim 8, wherein the first step of elongating has a temperature not higher than a $\beta$ transus temperature and a working ratio of at least 30%.

11. A process for working $\beta$ titanium alloy as claimed in claim 8, wherein the fourth step of working has a temperature within a temperature range of a $\beta$ transus minus 200° C. to a $\beta$ transus.

12. A process for working $\beta$ titanium alloy having superplastic elongation characteristics, comprising the sequential steps of: elongating a $\beta$ titanium alloy at a working ratio of at least 70%; precipitating an $\alpha$ phase in the $\beta$ titanium alloy within an $(\alpha+\beta)$ biphase temperature range between 400° C. and the $\beta$ transus temperature to uniformly precipitate a fine $\alpha$ phase; and working the $\beta$ titanium alloy within an isothermal working temperature range between 650° C. and the $\beta$ transus temperature to impart superplasticity to the $\beta$ titanium alloy.

13. A process for working $\beta$ titanium alloy having superplastic elongation characteristics, comprising the sequential steps of: elongating a $\beta$ titanium alloy at a temperature below a $\beta$ transus temperature and at a working ratio of at least 30% effective to uniformly introduce deformed bands and slip lines for precipitation sites in the entire $\beta$ titanium alloy; aging the $\beta$ titanium alloy at a temperature between 500° C. and 800° C. for at least one hour to uniformly precipitate an α phase at the precipitation sites; elongating the β titanium alloy at a temperature not higher than the aging temperature and at a working ratio of at least 70%; and recrystallizing the β titanium alloy; whereby strains introduced by elongating the β titanium alloy at the working ratio of at least 70% produce fine crystalline grains during the recrystallization of the β titanium alloy so as to form uniform fine recrystallized grains over the surface of the β titanium alloy.

14. A process for working β titanium alloy according to claim 13; wherein the β titanium alloy is recrystallized at a temperature not higher than the β transus temperature.

15. A process for working β titanium alloy having superplastic elongation characteristics, comprising the sequential steps of: elongating a β titanium alloy at a temperature no higher than a β transus temperature and a working ratio of at least 30% to limit precipitation of an α phase and prevent recrystallization; aging the β titanium alloy at a temperature in a range between the β transus temperature and the β transus temperature minus 200° C; elongating the β titanium alloy at a temperature not higher than the aging temperature and at a total working ratio of 70%; and working the β titanium alloy at an isothermal working temperature not higher than the β transus temperature to impart superplasticity to the β titanium alloy.

* * * * *